US009403188B2

(12) United States Patent
Rosenkranz et al.

(10) Patent No.: US 9,403,188 B2
(45) Date of Patent: Aug. 2, 2016

(54) TWO-STAGE METHOD FOR THE CORROSION PROTECTION TREATMENT OF METAL SURFACES

(75) Inventors: Christian Rosenkranz, Duesseldorf (DE); Andreas Arnold, Hilden (DE); Klaus Lepa, Troisdorf (DE); Konstantinos Markou, Cologne (DE)

(73) Assignee: Henkel AG & Co. KGaA, Düsseldorf (DE)

( * ) Notice: Subject to any disclaimer, the term of this patent is extended or adjusted under 35 U.S.C. 154(b) by 547 days.

(21) Appl. No.: 13/409,824

(22) Filed: Mar. 1, 2012

(65) Prior Publication Data

US 2012/0282404 A1 Nov. 8, 2012

Related U.S. Application Data

(63) Continuation of application No. PCT/EP2010/061592, filed on Aug. 10, 2010.

(30) Foreign Application Priority Data

Sep. 10, 2009 (DE) ..... 10 2009 029 334

(51) Int. Cl.
*B05D 5/00* (2006.01)
*B05D 3/10* (2006.01)

(52) U.S. Cl.
CPC . *B05D 5/00* (2013.01); *B05D 3/107* (2013.01); *B05D 2202/00* (2013.01)

(58) Field of Classification Search
CPC ..... B05D 2202/00; B05D 3/107; B05D 5/00
USPC ..... 427/337, 457
See application file for complete search history.

(56) References Cited

U.S. PATENT DOCUMENTS

| | | | | |
|---|---|---|---|---|
| 4,636,264 | A | 1/1987 | Schellenberg et al. | |
| 5,667,845 | A | 9/1997 | Roberto et al. | |
| 6,410,092 | B1 | 6/2002 | Yang et al. | |
| 6,613,387 | B2 | 9/2003 | Agarwal et al. | |
| 2004/0144451 | A1 * | 7/2004 | Matsukawa | C23C 22/34 148/247 |
| 2004/0153736 | A1 * | 8/2004 | Viswanathan et al. | 714/6 |
| 2004/0163736 | A1 * | 8/2004 | Matsukawa et al. | 148/247 |
| 2004/0244874 | A1 | 12/2004 | Nakayama et al. | |
| 2004/0244875 | A1 * | 12/2004 | Yasuda et al. | 148/247 |
| 2005/0065242 | A1 * | 3/2005 | McGee et al. | 523/402 |
| 2005/0065343 | A1 * | 3/2005 | Mendelovici | C07C 231/02 546/158 |
| 2009/0255608 | A1 * | 10/2009 | Brouwer | C23C 22/365 148/241 |
| 2011/0189401 | A1 * | 8/2011 | Czika | C23C 22/34 427/304 |
| 2012/0186986 | A1 * | 7/2012 | Schmidt | C23C 22/34 205/210 |

FOREIGN PATENT DOCUMENTS

| | | | | |
|---|---|---|---|---|
| CN | 101163820 | A | 4/2008 | |
| DE | 3442985 | A1 | 5/1986 | |
| DE | 3500443 | A1 | 9/1986 | |
| DE | 102007059969 | A1 | 6/2009 | |
| EP | 0716627 | B1 | 12/1999 | |
| WO | 9610461 | A1 | 4/1996 | |
| WO | 9847631 | A1 | 10/1998 | |
| WO | WO 9847631 | A1 * | 10/1998 | B05D 5/005 |
| WO | 0242008 | A1 | 5/2002 | |

OTHER PUBLICATIONS

International Search Report for PCT/EP2010/061592, mailed Oct. 22, 2010.

German Examination Report for priority application DE 10 2009 029 334.5-45, issued Jul. 12, 2010.

* cited by examiner

*Primary Examiner* — Dah-Wei D Yuan
*Assistant Examiner* — Kristen A Dagenais
(74) *Attorney, Agent, or Firm* — Mary K. Cameron

(57) ABSTRACT

The invention relates to an at least two-stage method for corrosion protection treatment of metal surfaces, wherein, in a first step (i), an organic coating comprising an aqueous phase (A) is applied to the metal surface and, in a following step (ii), the organic coating applied to the metal surface contacted with an acidic, aqueous composition (B) comprising at least one or more water-soluble compounds containing at least one atom selected from the elements Zr, Ti, Si, Hf, V and/or Ce and one or more water-soluble compounds that release copper ions. The invention further comprises a metal component that is at least partially made of steel, iron, zinc and/or aluminum and the alloys thereof and has been treated by the method according to the invention, and to the use thereof in automobile construction and in the construction industry and for producing household appliances and electronics housings.

13 Claims, No Drawings

TWO-STAGE METHOD FOR THE CORROSION PROTECTION TREATMENT OF METAL SURFACES

The present invention relates to an at least two-stage method for corrosion-protective treatment of metal surfaces, in which method, in a first step (i) an organic coating made up of an aqueous phase (A) is applied onto the metal surface, and in a subsequent step (ii) the organic coating applied onto the metal surface is brought into contact with an acidic aqueous composition (B) that comprises at least one or more water-soluble compounds containing at least one atom selected from the elements Zr, Ti, Si, Hf, V, and/or Ce, and one or more water-soluble compounds that release copper ions. The present invention furthermore encompasses a metallic component that is produced at least partly from steel, iron, zinc, and/or aluminum and alloys thereof and has been treated using the method according to the present invention, and the use thereof in automobile construction and the construction sector, and for the manufacture of household appliances and electronics housings.

In the automotive industry, the corrosion-protective application of paint systems made up of aqueous binding agent dispersions during body production is existing art. The automotive industry makes use principally of dip coating, in which the basic bodies, pretreated in corrosion-protective fashion, are introduced in a continuous process into a dip tank containing a dispersed paint system, deposition of the paint occurring either by application of an external voltage (electrodip coating) or in autodepositing fashion merely as a result of contact with the metal surfaces (autophoretic dip coating). The body then experiences a heat treatment so that film formation and crosslinking of the paint system deposited on the metal surface occurs, ensuring a high level of corrosion protection and allowing subsequent application of further coatings.

Autophoretic baths thus serve for the organic coating of metallic surfaces, usually iron surfaces, as a corrosion-protective primer coating on metallic components, or as an adhesive intermediate layer in the manufacture of metal-elastomer composites, for example for vibration-damping components in the automotive industry. Autophoretic coating is therefore a dip coating process that, in contrast to electrodip coating, takes place in electroless fashion, i.e. without application of an external voltage source. The autodeposition compositions are usually aqueous dispersions of organic resins or polymers which, upon contact with the metallic surface, coagulate in a thin liquid layer directly at the surface of the component as a result of pickling-based removal of metal cations, and thereby cause layer growth.

The use of autophoresis baths for dip coating deposition has lately become more important in automobile production and especially in parts-related production of metallic preforms, for example organic initial coating of wheel rims. Especially in the case of dip coating by means of autophoretically acting resp. so-called autodeposition compositions, however, a post-treatment is necessary in order to "heal" defects in the organic coating prior to a heat treatment that crosslinks the paint.

In order to improve the corrosion resistance of the organic coatings applied onto the metal surface using autophoretic methods, the existing art proposes an aqueous reaction rinse subsequent to the organic initial coating with the dip coat.

One such reaction rinse corresponds, according to DE 10 2007 059969, to a passivating post-treatment of the uncrosslinked coating, and brings about an inorganic conversion of the bare metal surface at so-called micro-defects, for example with the aid of phosphate-containing solutions that can furthermore contain alkali and/or alkaline-earth cations and also transition-metal cations, as well as fluoro complexes thereof.

U.S. Pat. No. 6,410,092 accordingly discloses a chromium-free reaction rinse based on water-soluble alkaline-earth metal salts, by preference calcium nitrate, while in WO 02/42008, water-soluble salts of metals of groups IIa and IIb, by preference zinc salts, are used; in addition, soluble phosphates and so-called accelerators (which have an oxidizing effect) are said to be contained in the reaction rinse.

Proceeding from this existing art, the object of the present invention is to develop a method for the initial deposition of hardenable organic binding agent systems onto metal surfaces and from an aqueous phase, in such a way that the corrosion resistance of the metal surface protected by the cured organic binding agent system is further improved.

The object is achieved by means of a multi-stage method for corrosion-protective treatment of metal surfaces, in which method, in a first step (i) an organic coating made up of an aqueous phase (A) is applied onto the metal surface, wherein the metal surface having the organic coating is, in a subsequent step (ii), brought into contact with an acidic aqueous composition (B) that comprises at least a) one or more water-soluble compounds containing at least one atom selected from the elements Zr, Ti, Si, Hf, V, and/or Ce, and
b) one or more water-soluble compounds that release copper ions.

The metal surface that is equipped in a first step (i) with an organic coating can represent a bare metal surface that, in a cleaning and/or pickling step preceding the method according to the present invention, has organic contaminants removed from it. A bare metal surface of this kind is notable for the fact that it is largely free of organic contaminants, for example corrosion protection oils, and there exists on its surface no (or only an ultra-thin) oxide covering layer that is made up of metallic elements of the metallic substrate and has a layer thickness of only a few nanometers.

Metal surfaces according to the present invention are, however, also those surfaces that have experienced, before the method step (i) according to the present invention, a conversion treatment during which an inorganic covering layer was formed. Inorganic conversion layers of this kind can be made up of both metallic elements of the metal substrate and extraneous metals. Typical conversion coatings are produced upon contact between bare metal surfaces and acidic aqueous solutions that contain water-soluble compounds of the elements Zr, Ti, Si, Hf, V, Ce, Mo, Zn, Mn, Fe, and in addition, optionally, anions that form poorly soluble salts, such as phosphates, and/or complexing ions such as fluoride ions. The conversion treatment produces amorphous or crystalline inorganic covering layers on the metal surface; metal surfaces are still in accordance with present invention, and can be used for the method according to the present invention, if the layer weight per unit area of the inorganic covering layers is equal to no more than 3 $g/m^2$.

An organic coating that is applied onto the metal surface in the first method step (i) is in accordance with the present invention if it contains a hardenable organic binding agent system. The method step (i) according to the present invention encompasses only the application of this organic coating, but not curing thereof by means of additional technical actions in order to crosslink the binding agent system. Additional technical actions of this kind are, for example, heat treatment (thermal curing) or actinic irradiation (radiation hardening) of an organic coating, applied in step (i), that contains the hardenable binding agent system. The method step (i) does, however, optionally encompass a heat treatment of the metal surface treated with the aqueous phase (A) in order to evaporate some of the water that remains in the wet film on the treated metal surface, even though the heat treatment has been performed below the curing temperature of the organic binding agent system. The organic coating that was applied out of the aqueous phase (A) therefore also contains a portion of water. The organic coating can furthermore contain leveling agents, surfactants, corrosion inhibitors, salts, pigments, and other active substances and adjuvants known to one skilled in the art of coatings technology. The solids content of the organic coating is, however, equal to at least 20 wt %. An "organic coating" is understood as that portion of a wet film of the aqueous phase (A) containing a hardenable organic binding system, applied in step (i), which remains on the metal surface, after a rinsing step under running water immediately subsequent to step (i), as a permanently adhering film containing the hardenable organic binding agent system.

Deposition of the organic coating in step (i) of the method according to the present invention occurs from an aqueous phase (A). The type of deposition is not linked to specific technical actions, however, and it can occur by electrodip coating of the metal surface or by electroless methods such as autophoretic deposition and the mechanical application methods known in the existing art (roller application methods, spray methods).

It is, however, in particular in the context of electroless deposition of the organic coating in method step (i) from an aqueous phase (A) that the method according to the present invention exhibits the most significant improvement in the corrosion resistance of the metal surfaces treated in the method according to the present invention. Those methods according to the present invention in which application of the organic coating in the first step (i) occurs in electroless fashion, in particular autophoretically, by bringing the metallic surface into contact with an aqueous phase (A) containing the organic binding agent, are accordingly preferred.

If what occurs in the first step (i) of the method according to the present invention is autophoretic deposition of the organic coating onto the metal surface, then the aqueous phase (A) preferably has a pH of less than 4 and preferably contains a) at least one dispersed organic binding agent system that is thermally hardenable, by preference at temperatures below 300° C., by preference below 200° C.,
b) iron(III) ions, and
c) fluoride ions in a quantitative proportion such that the molar ratio of fluoride ions to iron(III) ions from water-soluble compounds is equal to at least 2:1.

For an autophoretic deposition of this kind, the aqueous phase (A) in step (i) of the method according to the present invention preferably contains at least 1 wt % of the organic binding agent system.

"Thermally hardenable" organic binding systems are those binding agent systems that possess curing temperatures above 20° C. and below the indicated temperatures of 300° C., by preference below 200° C.

The "curing temperature" is the highest temperature that, in a dynamic differential calorimetric analysis (DSC) over a temperature range from 20° C. to 400° C. at a heating rate of 10 K/min of a solids mixture of the organic binding agent systems used, denotes the maximum of an exothermic process. Calorimetric analysis of the exothermic quantities of heat released from the sample volume of the solids mixture and recorded by DSC is accomplished in accordance with DIN 53 765 in consideration of DIN EN ISO 11357-1. A solids mixture of the organic binding agent system used is accessible by vacuum freeze-drying of an aqueous dispersion of the binding agent system. Alternatively, the aqueous dispersion of the binding agent system can be dried at room temperature in the sample crucible for DSC measurement, and the sample weight of solids mixture in the sample crucible can be ascertained by differential weighing. The aqueous phase (A) is particularly suitable as an aqueous dispersion.

Thermally crosslinkable resp. hardenable organic binding agent systems in accordance with component a) of aqueous phase (A), which are deposited in step (i) of a method preferred according to the present invention in electroless fashion by autophoretic deposition onto the metal surface, are made up of organic oligomeric or polymeric compounds having at least two functional groups, and are consequently capable of reacting with one another in condensation or addition reactions with the formation of covalent bonds, and thereby building up a network of covalently linked oligomeric or polymeric compounds. Thermally crosslinkable resp. hardenable binding agent systems can be made up either of a self-crosslinking oligomeric or polymeric compound having two different or identical functional groups capable of reacting with one another, or of at least two different oligomeric or polymeric compounds that crosslink with one another as a result of their functionalization.

The organic binding agent system dispersed in water in accordance with component a), which is applied in step (i) of a method according to the present invention in electroless fashion onto the metal surface, contains at least one thermally self-crosslinking organic polymer and/or a mixture of at least one crosslinkable organic polymer resp. a resin and an organic hardener that can react with the crosslinkable functionalities of the organic polymer resp. the resin in an addition or condensation reaction. The organic hardener can likewise be an organic polymer resp. a resin.

For sufficient filming of the hardenable binding agent system on the metal surface, it is further preferred that the organic binding agent system dispersed in the aqueous phase (A) in step (i) of the method according to the present invention have a film formation temperature of no more than 80° C., particularly preferably no more than 40° C. If the film formation temperature of the binding agent is above the preferred 80° C., this can result in an inhomogeneous organic coating of the metal surface during the reaction rinse with an acidic aqueous composition (B) in step (ii) of the method according to the present invention, which cannot be remedied even in the curing process that usually follows the method according to the present invention. This kind of inhomogeneous coating of the metal surface with the organic binding agent system has a disadvantageous effect on the corrosion resistance and visual impression of the coated metal surface.

Because it is advantageous that the organic binding agent system deposited in step (i) onto the metal surface form a film already during the reaction rinse in step (ii), those methods according to the present invention in which the acidic aqueous composition (B) is brought, in step (ii), into contact with the metal surface having the organic coating at a temperature of at least 30° C., particularly preferably at least 40° C., but by preference no more than 80° C., are preferred.

The dispersed organic binding agent system used in step (i) of the method preferred according to the present invention for electroless deposition is by preference made up of at least one copolymerizate and/or polymer mixture of acrylates with at least one oligomeric and/or polymeric compound selected from epoxy resins, phenol resins, and/or polyurethane resins.

Water-dispersible epoxy resins bring about, as a crosslinked coating on a metal surface, a particularly good barrier effect with respect to corrosive media, and are therefore a preferred constituent of the dispersed binding agent system in a method preferred according to the present invention in which, in step (i), the organic coating is applied in electroless fashion, i.e. via an autodeposition process. Optionally, crosslinking hardeners, preferably based at least in part on phenol resins, can be used in addition to the epoxy resin in order to accelerate the curing process and increase the degree of crosslinking. Further hardeners that crosslink the epoxy resin are those based on isocyanate resins, the isocyanate groups of which can also be present in blocked fashion. Moderately reactive isocyanates are preferred as preferred blocked isocyanate resins, for example aliphatic isocyanates and sterically hindered isocyanates and/or isocyanates blocked in acid-stable fashion.

It is also possible to use, as an epoxy resin, incompletely crosslinked oligomeric or polymeric compounds having free, for example terminally bonded, epoxy groups, the preferred molecular weight of which is no less than 500 u and no greater than 5000 u. Examples of such epoxy resins are those based on bisphenol A and bisphenol F, as well as epoxy-phenol novolacs.

For reasons of economy and commercial availability, epoxy resins based on bisphenol A, which correspond to the following general structural formula (III):

(III)

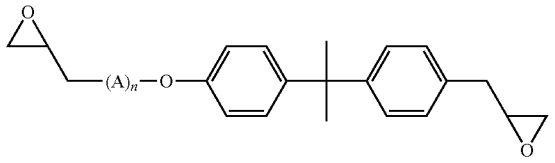

are preferably used in the context of the present invention.

The structural module A corresponds here to the following general formula (IV):

(IV)

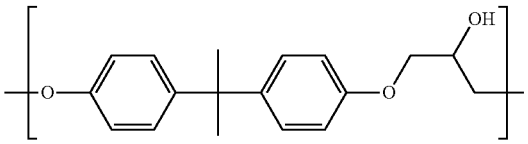

where n is a whole number from 1 to 50.

Preferred epoxies have an epoxy equivalent weight (EEW) of no less than 100 g/eq, but no more than 5000 g/eq. The EEW indicates here the average molecular weight per mol of epoxy functionality in the epoxy resin, in grams per molar equivalent (g/eq). Particularly preferred ranges for the epoxy equivalent weight exist for specific epoxy resins:

| | |
|---|---|
| Brominated epoxy resins | 300 to 100 g/eq, in particular 350 to 600 |
| Polyalkylene glycol epoxy resins | 100 to 700 g/eq, in particular 250 to 400 |
| Liquid epoxy resins | 150 to 250 g/eq |
| Solid/pasty epoxy resins | 400 to 5000 g/eq, in particular 600 to 100 |

As phenol resins, incompletely crosslinked oligomeric or polymeric polycondensation products of formaldehydes with phenols can be present in dispersed fashion in the aqueous phase (A) in step (i) of the preferred method according to the present invention for electroless deposition of the organic coating, said products preferably comprising at least partly etherified hydroxyl groups and their preferred average molecular weight being no less than 500 u and no greater than 10,000 u. The hydroxyl groups are present, in this context, by preference in methoxylated, ethoxylated, propoxylated, butoxylated, or ethenyloxylated fashion. Both resols and novolacs can be used as phenol resin types.

Further optional constituents of the aqueous phase (A) that, upon contact with metal surfaces, bring about an autophoretic deposition of an organic coating as defined by this invention are leveling agents, such as glycol ethers and alcohol esters, for better film formation of the deposited organic coating on the metallic surface, micronized inorganic fillers such as sulfates, oxides, and phosphates having average particle sizes below 5 μm, by preference below 1 μm, to increase the scratch resistance and corrosion resistance of the organic coating in the cured state, as well as pigments for coloring, for example Aquablack® 255A of Solutions Inc.

With regard to composition (B) of the reaction rinse in step (ii) of the method according to the present invention, it has been possible to ascertain that acidic aqueous compositions (B) containing a) at least a total of 100 ppm, but no more than 2000 ppm, water-soluble compounds containing at least one atom selected from the elements Zr, Ti, Si, Hf, V, and/or Ce, calculated as a proportion of the respective element, in particular no more than 800 ppm water-soluble compounds containing at least one atom selected from the elements Zr, Ti, and/or Si, particularly preferably Zr and/or Ti, calculated as a proportion of the respective element, and
b) at least 1 ppm, but no more than 100 ppm, in particular no more than 50 ppm, water-soluble compounds that release copper ions, calculated as a proportion of copper, are preferred.

If the proportion of water-soluble compounds in accordance with component a) is much below the preferred value, the "healing" of defects in the organic coating deposited from the aqueous phase then does not occur sufficiently, and an additional positive effect due to the presence of the compounds in accordance with component b) that release copper ions is absent.

Conversely, it has been found that if the quantity of copper-ion-releasing compounds in accordance with component b) falls considerably below the preferred value, the reaction rinses obtained are ones that result in no improvement in the corrosion resistance of the metal surface equipped with the cured organic binding agent system, as compared with reaction rinses known in the existing art and made up exclusively of compounds in accordance with component a). The addition of small quantities of copper-ion-releasing compounds to a reaction rinse (B) containing a component a) does, however, already bring about a considerable increase in the corrosion resistance of a metal surface that has been treated according to method step (i). Quantities of copper-ion-releasing compounds above 50 ppm, based on copper, do not contribute further to an increase in corrosion resistance and are therefore uneconomical, while greater additions above 100 ppm once again cause a slight degradation in corrosion resistance.

The reaction rinse to be performed in step (ii) of the method according to the present invention, by bringing it into contact with the metal surface having the organic coating, occurs by preference at a pH value for the acidic aqueous composition (B) of no lower than 2 and no higher than 5. Lower pH values can, depending on the organic binding system used, chemically modify the organic coating and initiate decomposition reactions. In addition, elevated acid corrosion of the metallic substrate, and the formation of nascent hydrogen, can permanently damage the interface between the metal and the organic coating. Compositions having pH values above 5 are also less preferred because the compositions (B) tend to form poorly soluble precipitates as a result of hydrolysis reactions of the water-soluble compounds in accordance with components a).

For improved complexing of the metal cations that are dissolved out of the metal substrate carrying the hardenable organic coating as a result of the pickling process, in the method according to the present invention in step (ii) fluoride ions can additionally be contained in the acidic aqueous composition (B). Preferably, however, the proportion of fluoride ions in composition (B) does not exceed values for which the measured free fluoride proportion is higher than 400 ppm, although for an intensified pickling effect on the substrate and effective complexing of the metal cations, at least 1 ppm free fluoride should be present in composition (B). Hydrogen fluoride, alkali fluorides, ammonium fluoride, and/or ammonium bifluoride serve, for example, as a source of fluoride ions.

Preferred water-soluble compounds of component a) in step (ii) of the method according to the present invention are compounds that dissociate in aqueous solution into anions of fluoro complexes of the elements zirconium, titanium, and/or silicon, particularly preferably fluoro complexes of the elements zirconium and/or titanium. Preferred compounds of this kind are, for example, $H_2ZrF_6$, $K_2ZrF_6$, Na $ZrF_6$, and $(NH_4)_2ZrF_6$, and the analogous titanium resp. silicon compounds. Fluorine-containing compounds of this kind in accordance with component a) are at the same time a source of free fluoride. Fluorine-free compounds of the elements titanium and/or zirconium can also be used according to the present invention as water-soluble compounds in accordance with component A), for example $(NH_4)_2Zr(OH)_2(CO_3)_2$ or $TiO(SO_4)$.

Preferred water-soluble compounds of component b) in step (ii) of the method according to the present invention are all water-soluble copper salts that contain no chloride ions. Copper sulfate, copper nitrate, and copper acetate are particularly preferred.

The acid compositions used in step (ii) of the method according to the present invention can additionally contain so-called "depolarizers," which as a result of their mild oxidizing effect suppress the formation of nascent hydrogen at bare metal surfaces during the reaction rinse. The addition of such depolarizers, which are known in the technical field of phosphating of metal surfaces, is therefore likewise preferred according to the present invention. Typical representatives of depolarizers are chlorate ions, nitrite ions, hydroxylamine, hydrogen peroxide in free or bound form, nitrate ions, m-nitrobenzenesulfonate ions, m-nitrobenzoate ions, p-nitrophenol, N-methylmorpholine-N-oxide, nitroguanidine.

For environmental reasons and in order to avoid inorganic heavy-metal-containing sludges that must be laboriously processed and disposed of, the use of water-soluble phosphates and chromates in the acidic aqueous composition (B) of the reaction rinse in step (ii) is largely omitted. A composition (B) in the reaction rinse, i.e. in step (ii) of the method according to the present invention, preferably contains no more than 1 ppm soluble phosphates and chromates, calculated as the sum of $PO_4$ and $CrO_4$, particularly preferably no soluble phosphates and chromates. The present invention is moreover notable for the fact that the presence of soluble phosphates in step (ii) of the method can be dispensed with, but that outstanding corrosion resistance in the metal substrates treated according to the present invention nevertheless results.

The operation of bringing the aqueous phase (A) in step (i), and the acidic aqueous composition in step (ii), into contact with the metal substrate or the metallic component occurs, in the method according to the present invention, preferably in a dip or spray method, the dip method being particularly preferable because of the more homogeneous wetting of the surface.

To avoid the drag-over of constituents of the aqueous phase (A) from step (i) into the acidic aqueous composition (B), those methods according to the present invention in which a rinsing step occurs between the first step (i) and the subsequent step (ii), in order to remove components of the aqueous phase (A) from the treated metal surface, are preferred. This action moreover increases the effectiveness of the reaction rinse with the acidic aqueous composition (B), since polymer particles that are not, or are insufficiently, adhering to the metal surface are removed, so that the acidic aqueous composition can act directly on the permanently adhering organic coating.

The contact times with the respective aqueous compositions are not critical for the method according to the present invention, but in step (i) should preferably be selected so that the layer weight of the uncured, but permanently adhering, organic coating applied in step (i) of the method according to the present invention is equal, immediately before the reaction rinse with the acidic aqueous composition (B) in step (ii), by preference to at least 10 $g/m^2$, particularly preferably at least 20 $g/m^2$, but by preference no more than 80 $g/m^2$. Experience indicates that lower layer weights result in inhomogeneous coatings that impart a lower level of corrosion resistance to the metal surface, while higher layer weights do not substantially improve the corrosion resistance of the coated metal substrate. The layer weight of the uncured but permanently adhering organic coating is determined after rinsing the metal substrate coated in step i) of the method according to the present invention under running deionized water, the rinse being carried out until the rinse water flowing off the metal substrate does not appear turbid.

The contact times for the reaction rinse with the acidic aqueous composition (B) to be performed in step (ii) of the method according to the present invention are by preference 50 to 100% of the contact time with the aqueous phase (A) in step (i).

The organic coating that is applied onto the metal surface in step (i) and post-treated in step (ii) is by preference cured at elevated temperature, with or without an interposed rinsing step in order to remove components of the acidic aqueous composition (B) from the treated metal surface, in order to crosslink the polymeric coating as completely and permanently as possible and thereby enhance corrosion resistance. The process of curing the organic coating is carried out preferably at temperatures above the curing temperature of the binding agent dispersed in the aqueous phase (A), and below 300° C.

The present invention also encompasses the metallic component manufactured in the method according to the present invention, the component by preference being produced at least partly from steel, iron, zinc, and/or aluminum as well as alloys thereof.

A component of this kind according to the present invention is utilized in automobile construction and the construction sector, and for the manufacture of household appliances and electronics housings.

EXEMPLIFYING EMBODIMENTS

The effect of the reaction rinse performed in step (ii) of the method according to the present invention in improving the corrosion resistance of the coated metal substrate is presented below by way of example for specific organic binding agent systems that are applied onto steel surfaces using an autophoretic process.

The CRS panels were first degreased for 7 minutes with a highly alkaline cleaner (3 wt % ACL® 1773, 0.3 wt % ACL® 1773T, Henkel Co.), and then washed with tap water and deionized water.

The panels were then immersed for 2 minutes into the respective autodeposition bath for application of the organic coating (step i), then rinsed under running deionized water for one minute, and post-treated in step (ii) for one minute in a reaction rinse (ARR® E2, Henkel KGaA) and again rinsed with deionized water.

In a subsequent step, the panels coated in this fashion were filmed and hardened in a recirculating oven. The layer thickness after curing, both for the method according to the present invention and in the comparison experiments, was approx. 20 μm, and was determined using a PosiTector® (DeFelsco Corp.).

This was followed by quantification of the corrosion resistance of the steel panels coated and treated in this fashion, based on infiltration in the DIN 50021 NSS test. The results thereof are listed in Table 1.

The organic coatings applied in step (i) onto the steel surface in an autophoretic process, from aqueous autodepositing dispersions of the respective binding agent system, are all based on a polymer mixture of epoxy resin (EEW: 500 to 575 g/eq; Mn: 1200 g/mol DER® 664 UE, Dow Chemicals) and polyacrylates, additionally containing a quantity of a hardener such that the weight ratio of epoxy resin is in each case 70:30. The organic solids content of the aqueous dispersions is approx. 4 wt %, and the proportion of epoxy resin in the solids portion is approx. 45 wt %. In addition, 0.14 wt % iron(III) fluoride, 0.05 wt % hydrogen fluoride, and 2.1 wt % hydrogen peroxide are contained in the aqueous phase for autophoretic deposition of the binding agent system.

The hardeners used, which are constituents of the organic binding agent system in the aqueous phase (A), are either a phenolic resin (4,4'-isopropylidenediphenol, GP-Phenolic Resin® BKS 7550, Ashland-SUdchemie-Kernfest) or an isocyanate resin (Vestagon® B1530, Evonik Co.) (see Table 1).

Corrosive infiltration values after 504 hours of NSS testing for the respective organic coating on sheet steel, applied and cured in the method presented above, may be gathered from Table 1.

It is evident that even small quantities of copper ions in the acidic aqueous composition (B) in the method according to the present invention bring about a significant improvement in infiltration values, as is apparent from a comparison of examples C1 and E1, C2 and E6, and C3 and E10. The addition of copper ions is especially advantageous for the corrosion resistance of the steel surfaces equipped with the cured organic coating in a context of high Zr concentrations in the acidic aqueous composition. Increasing concentrations of copper ions gradually result again in a deterioration in corrosion resistance (examples B1 to B5); for the binding agent system having the isocyanate resin as a hardener, a deterioration in the infiltration values as compared with a reaction rinse that contains only $H_2ZrF_6$ and no copper ions can already be detected above 100 ppm (examples C1 and E5).

Corrosive infiltration on steel panes that were autophoretically coated with a binding agent system, post-treated in a reaction rinse with an acidic aqueous composition, and thermally cured.

| Example | Hardener in binding agent system of aqueous phase (A) | Acidic composition (B), pH 4 | | Neutral salt spray test* |
|---|---|---|---|---|
| | | Zr[1] [ppm] | Cu[2] [ppm] | Infiltration [mm] |
| C1 | Isocyanate resin | 400 | — | 5.0 |
| C2 | Phenolic resin | 400 | — | 4.5 |
| C3 | Phenolic resin | 1200 | — | 6.0 |
| E1 | Isocyanate resin | 400 | 5 | 3.5 |
| E2 | Isocyanate resin | 400 | 10 | 3.0 |
| E3 | Isocyanate resin | 400 | 20 | 3.5 |
| E4 | Isocyanate resin | 400 | 50 | 4.0 |
| E5 | Isocyanate resin | 400 | 120 | 5.5 |
| E6 | Phenolic resin | 400 | 3 | 3.0 |
| E7 | Phenolic resin | 400 | 5 | 3.0 |
| E8 | Phenolic resin | 400 | 10 | 3.0 |
| E9 | Phenolic resin | 400 | 20 | 4.0 |
| E10 | Phenolic resin | 1200 | 3 | 4.0 |
| E11 | Phenolic resin | 1200 | 5 | 4.0 |
| E12 | Phenolic resin | 1200 | 10 | 4.0 |
| E13 | Phenolic resin | 1200 | 20 | 4.0 |

*per DIN 50021

[1]as $H_2ZrF_6$

[2]as $Cu(NO_3)_2$

Isocyanate resin: this organic coating was cured for 40 minutes at 185° C. after treatment with composition (B)

Phenolic resin: this organic coating was cured for 25 minutes at 150° C. after treatment with composition (B)

What is claimed is:

1. A method for corrosion-protective treatment of metal surfaces, comprising: in a first step (i) applying an organic coating made up of an aqueous phase (A) onto the metal surface, wherein the metal surface having the organic coating is, in a subsequent step (ii), brought into contact with an acidic aqueous composition (B) that comprises at least a) one or more water-soluble compounds containing at least one atom selected from the elements Zr, Ti, Si, Hf, V, and Ce, and b) one or more water-soluble compounds that release copper ions;

wherein the acidic aqueous composition (B) contains no more than 1 ppm soluble phosphates.

2. The method according to claim 1, wherein application of the organic coating in the first step (i) occurs in electroless fashion.

3. The method according to claim 2, wherein in the first step (i), the aqueous phase (A) has a pH of less than 4 and contains a) at least one dispersed organic binding agent system that is thermally curable, at temperatures below 300° C., b) iron(III) ions, and c) fluoride ions in a quantitative proportion such that the molar ratio of fluoride ions to iron(III) ions from water-soluble compounds is equal to at least 2:1.

4. The method according claim 1, wherein in the subsequent step (ii), the acidic aqueous composition (B) has a pH of 2 to 5, and comprises:

a) at least a total of 100 ppm, but no more than 2000 ppm, water-soluble compounds containing at least one atom selected from the elements Zr, Ti, Si, Hf, V, and Ce, calculated as a proportion of the respective element, and b) at least 1 ppm, but no more than 100 ppm, water-soluble compounds that release copper ions, calculated as a proportion of copper;

wherein (B) further comprises a depolarizer which suppresses formation of nascent hydrogen at bare metal surfaces during the subsequent step (ii).

5. The method according claim 4, wherein the depolarizer is selected from chlorate ions, nitrite ions, hydroxylamine, hydrogen peroxide in free or bound form, m-nitrobenzenesulfonate ions, m-nitrobenzoate ions, p-nitrophenol, N-methylmorpholine-N-oxide, nitroguanidine and mixtures thereof.

6. The method according claim 4, wherein in the subsequent step (ii), the acidic aqueous composition (B) has no more than 800 ppm of the water-soluble compounds containing at least one atom selected from the elements Zr, Ti, and/or Si, calculated as a proportion of the respective element; and the acidic aqueous composition (B) contains no soluble phosphates.

7. The method according claim 1, wherein the acidic aqueous composition (B) comprises fluoride ions in an amount such that measured free fluoride is at least 1 ppm and not higher than 400 ppm.

8. The method according claim 1, wherein in the acidic aqueous composition (B), the one or more water-soluble compounds a) comprise Zr, and V or Ce.

9. The method according claim 1, wherein in the first step (i), the organic binding agent system dispersed in the aqueous phase (A) has a film formation temperature of no more than 80° C. and in the subsequent step (ii), the acidic aqueous composition (B) is brought, at a temperature of at least 30° C., but no more than 80° C., into contact with the metal surface having the organic coating.

10. The method according claim 3, wherein after method step (ii) and with or without an interposed rinsing step to remove components of the acidic aqueous composition (B) from the treated metal surface, the organic coating of the metal surface is cured at temperatures above a curing temperature of the at least one dispersed organic binding agent system that is thermally curable and below 300° C.

11. The method according claim 1, wherein the metal surface is produced at least partly from steel, iron, zinc, and/or aluminum and, before the method step (i), is subjected to a conversion treatment comprising contacting bare metal surfaces and acidic aqueous solutions that comprise one or more water-soluble compounds of elements selected from Zr, Ti, Si, Hf, V, Ce, Mo, Zn, Mn, Fe, during which an inorganic covering layer forms having a layer weight per unit area of the inorganic covering layer of no more than 3 $g/m^2$.

12. The method according claim 1, wherein the metal surface is steel, iron, zinc, and/or aluminum; composition (B) comprises 400 to 1200 ppm Zr and 1 to 100 ppm Cu; and the dispersed organic binding agent system comprises a hardener selected from isocyanate resin and phenolic resin.

13. The method according claim 1, wherein after step (ii), the metal surface having the organic coating and the acidic aqueous composition (B) thereon is rinsed.

* * * * *